US007193582B2

(12) United States Patent
Wang

(10) Patent No.: US 7,193,582 B2
(45) Date of Patent: Mar. 20, 2007

(54) DIGITAL RECEIVING ANTENNA DEVICE FOR A DIGITAL TELEVISION

(75) Inventor: Cheng-Si Wang, Hua Tan Hsiang (TW)

(73) Assignee: Trans Electric Co., Ltd., Hua Tan Hsiang (TW)

( * ) Notice: Subject to any disclaimer, the term of this patent is extended or adjusted under 35 U.S.C. 154(b) by 0 days.

(21) Appl. No.: 11/151,623

(22) Filed: Jun. 13, 2005

(65) Prior Publication Data

US 2006/0290578 A1 Dec. 28, 2006

(51) Int. Cl.

| | |
|---|---|
| ***H01Q 1/42*** | (2006.01) |
| ***H01Q 9/04*** | (2006.01) |
| ***H01Q 7/00*** | (2006.01) |
| ***H01Q 1/24*** | (2006.01) |

(52) U.S. Cl. ..... 343/872; 343/791; 343/866; 343/702

(58) Field of Classification Search ..... 343/702, 343/788, 791, 842, 866, 850, 857, 872
See application file for complete search history.

(56) References Cited

U.S. PATENT DOCUMENTS

| | | | | |
|---|---|---|---|---|
| 4,342,999 | A * | 8/1982 | Woodward et al. | 343/702 |
| 4,717,921 | A * | 1/1988 | Ohe et al. | 343/712 |
| 4,719,471 | A * | 1/1988 | Killingsworth | 343/792 |
| 4,819,001 | A * | 4/1989 | Ohe et al. | 343/712 |
| 5,294,938 | A * | 3/1994 | Matsuo et al. | 343/829 |
| 5,355,142 | A * | 10/1994 | Marshall et al. | 343/700 MS |
| 5,734,350 | A * | 3/1998 | Deming et al. | 343/700 MS |
| 6,157,348 | A * | 12/2000 | Openlander | 343/846 |
| 6,246,368 | B1 * | 6/2001 | Deming et al. | 343/700 MS |
| 6,342,860 | B1 * | 1/2002 | Haussler et al. | 343/702 |
| 6,642,899 | B2 * | 11/2003 | Strickland et al. | 343/773 |
| 6,867,738 | B2 * | 3/2005 | Birnbaum et al. | 343/702 |

* cited by examiner

*Primary Examiner*—Don Wong
*Assistant Examiner*—Marie Antoinette Cabucos
(74) *Attorney, Agent, or Firm*—Alan D. Kamrath; Nikolai & Mersereau, P.A.

(57) ABSTRACT

A digital receiving antenna device is connected to a digital television through a coaxial cable and has a casing, a flat antenna, a coaxial cable connector and a coaxial transmission line. The flat antenna is mounted in the casing and connected electronically to the coaxial cable through the coaxial transmission line. Since the coaxial transmission line has a fixed capacitance without regard to the distance between the feed point and the coaxial cable connector, a fixed capacitor is connected between the flat antenna and the coaxial cable connector. Therefore, the coaxial transmission line can be used as a transmission line for different size flat antennas, and each coaxial transmission line will have the same impedance. These different size digital receiving antenna devices can use the same antenna signal processing circuit and still have an impedance match between the flat antenna and the antenna signal processing circuit.

5 Claims, 6 Drawing Sheets

DIGITAL RECEIVING ANTENNA DEVICE FOR A DIGITAL TELEVISION

BACKGROUND OF THE INVENTION

1. Field of the Invention

The present invention relates to a digital receiving antenna device and, more particularly, to a digital receiving antenna device for a digital television.

2. Description of Related Art

Digital televisions require a digital receiving antenna device to receive digital program signals so the televisions can display the video and play the audio. For portable digital televisions, the digital receiving antenna device is particularly important to provide good quality of the program video.

With reference to FIG. 5, a small conventional digital receiving antenna device connects to the digital television (not shown) through a coaxial cable (60) and has a casing (50), a flat antenna (51) and first and second transmission lines (522, 523).

The flat antenna (51) is mounted in the casing (50) and has a feed point (A) and a ground point (B). The feed point (A) and ground point (B) are respectively connected to a core conductor (61) and a braided layer (62) of the coaxial cable (60) respectively through the first and second transmission lines (522, 523). Since impedance of the flat antenna (51) and the impedance of an antenna signal processing circuit (not shown) must be matched, the antenna signal can be completely transmitted to the antenna signal processing circuit. Therefor, in addition to the impedance of the flat antenna (51) and the antenna signal processing circuit, impedance of the first and second transmission line (522, 523) has to been considered.

Digital televisions have different sizes, and different sizes of digital receiving antenna devices are required. With further reference to FIG. 6, a conventional large passive digital antenna device has a large casing (50*a*), a large flat antenna (51*a*) and a long first transmission line (522*a*) and a second transmission line (523). The large flat antenna (51*a*) has the same impedance as the smaller flat antenna (51*a*) as shown in FIG. 5.

The flat antenna (51*a*) is a distance from the coaxial cable (60), which is longer than that of the smaller digital receiving antenna device. Consequently, a longer first transmission line (522*a*) is required to connect between the large flat antenna (51*a*) and the external coaxial cable (60). Therefore, a new impedance of the longer first transmission line (522*a*) is generated and the antenna signal processing circuit is not adapted to use the large antenna device since the impedance no longer matches. In brief, the large rectangular antenna device needs to use a tailored antenna signal processing circuit.

Since different rectangular passive antenna devices do not use the same antenna signal processing circuit, fabricating cost of the passive digital antenna device will be increased.

The present invention provides a digital receiving antenna device that has a fixed impedance to overcome the problem with mismatched impedance with the antenna signal processing circuit in different size digital receiving antenna devices.

SUMMARY OF THE INVENTION

The main objective of the present invention is to provide a digital receiving antenna device with a fixed impedance to match the impedance of an antenna signal processing circuit.

A digital receiving antenna device is connected to a digital television through a coaxial cable and has a casing, a flat antenna, a coaxial cable connector and a coaxial transmission line. The flat antenna is mounted in the casing and connected electronically to the coaxial cable through the coaxial transmission line. Since the coaxial transmission line has a fixed capacitance without regard to the distance between the feed point and the coaxial cable connector, a fixed capacitor is connected between the flat antenna and the coaxial cable connector. Therefore, the coaxial transmission line can be used as a transmission line for different size flat antennas, and each coaxial transmission line will have the same impedance. These different size digital receiving antenna devices can use the same antenna signal processing circuit and still have an impedance match between the flat antenna and the antenna signal processing circuit.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
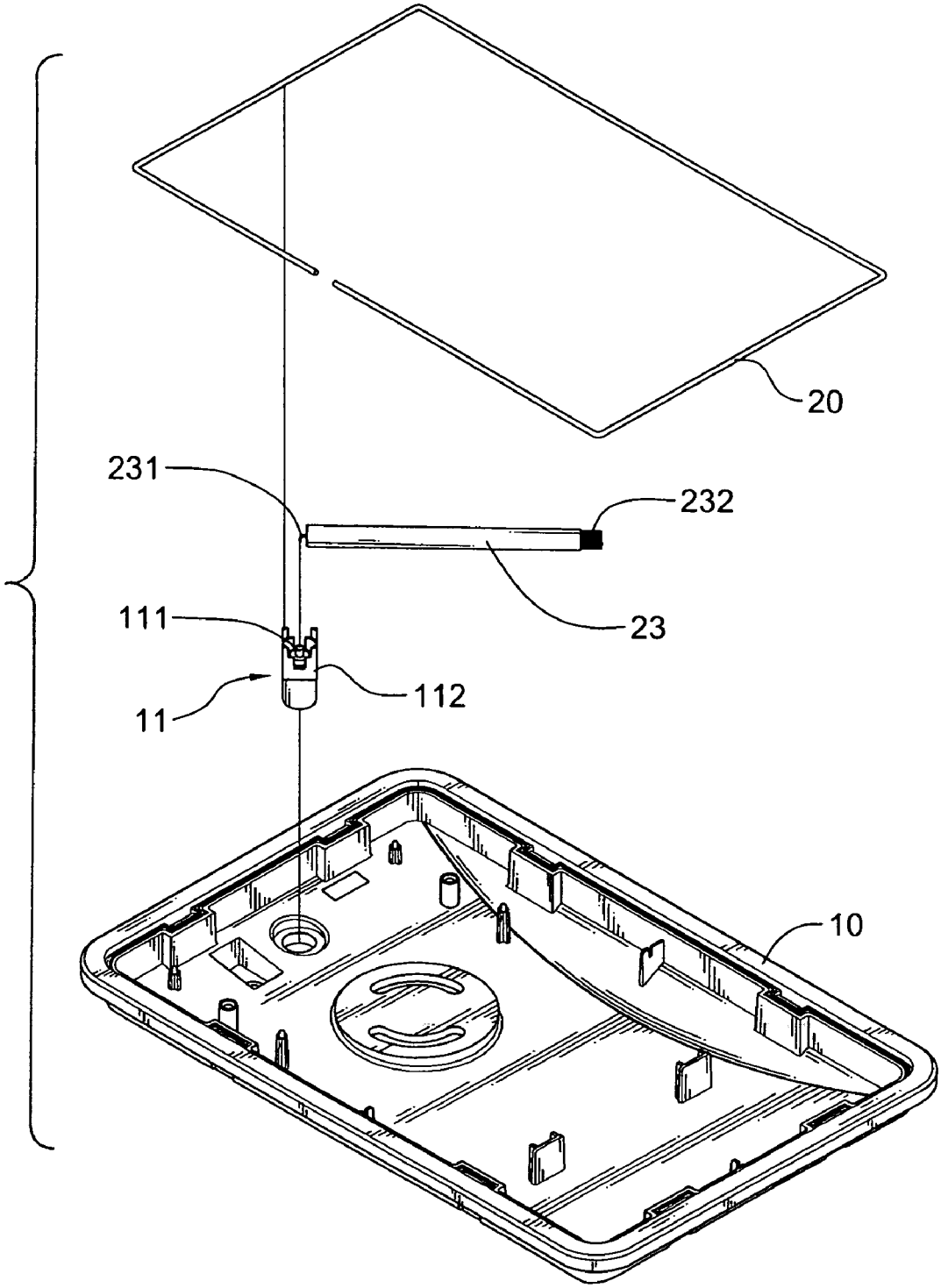
FIG. 1 is an exploded perspective view of a digital receiving antenna device in accordance with the present invention.
Figure 2:
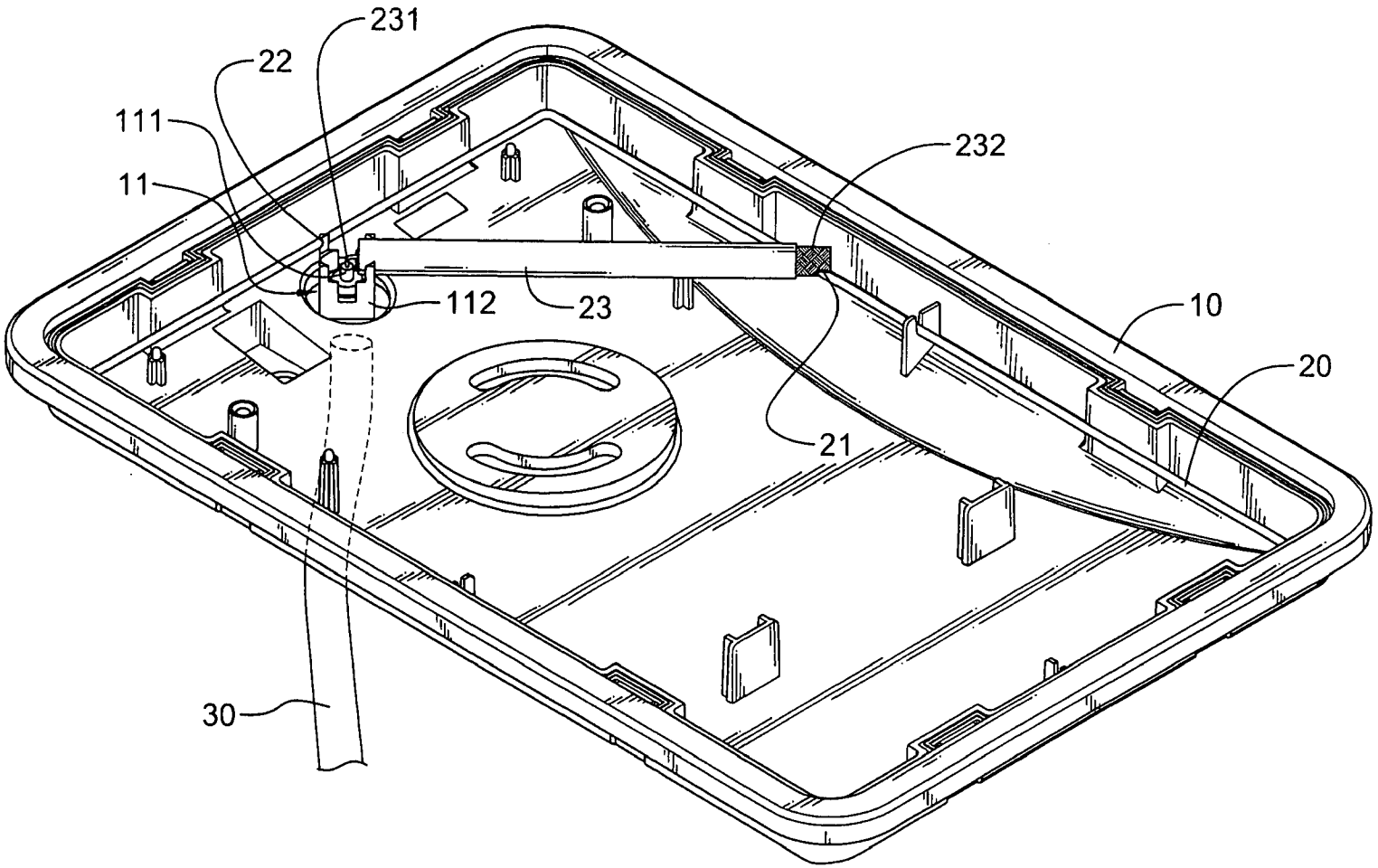
FIG. 2 is a perspective view of the digital receiving antenna device in FIG. 1.

With reference to FIGS. 1 and 2, a preferred embodiment a digital receiving antenna device in accordance with the present invention has a casing (10), a flat antenna (20), a coaxial cable connector (11) and a coaxial transmission line (23).

Figure 3:
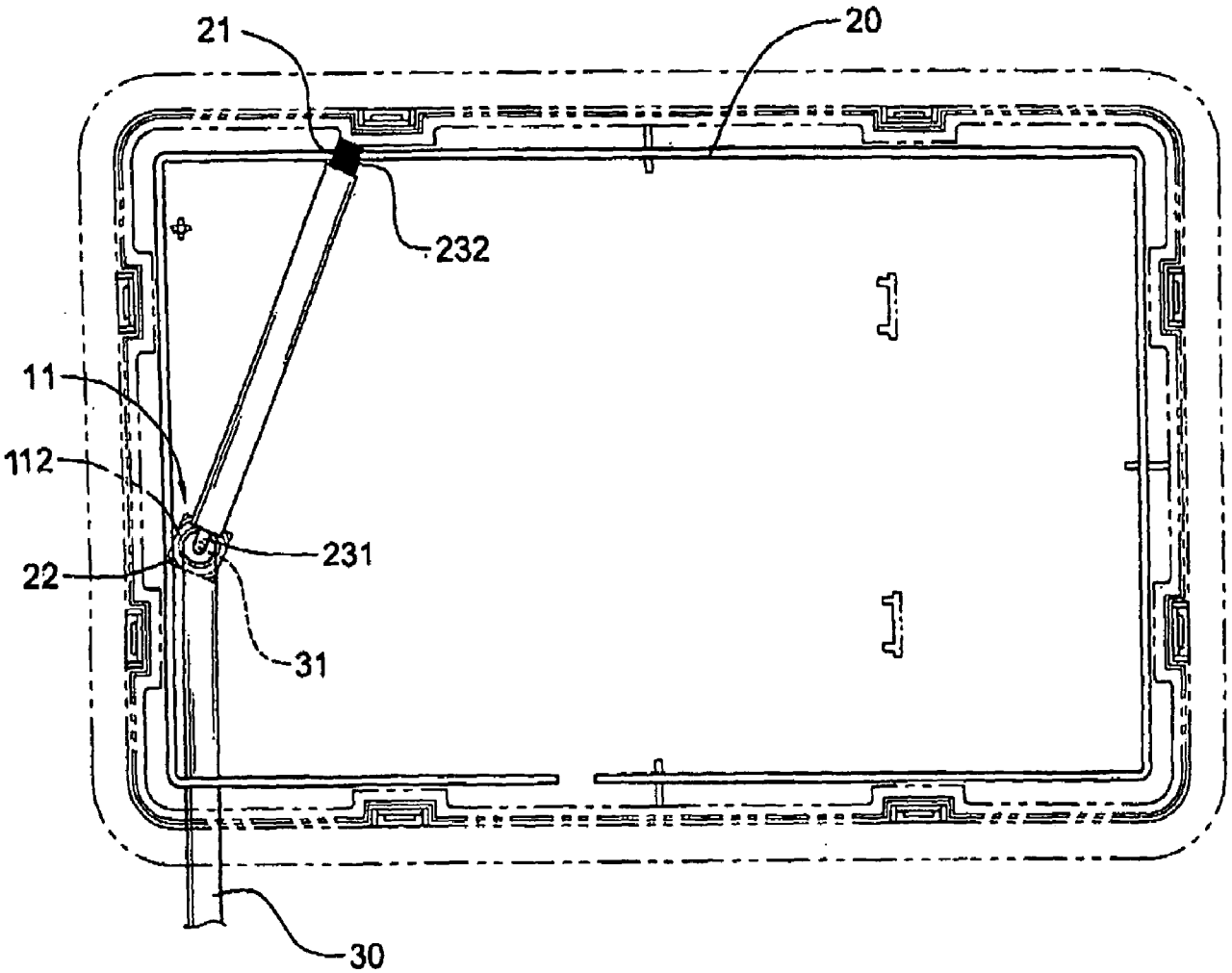
FIG. 3 is a top view of the digital receiving antenna device in FIG. 1.

With further reference to FIG. 3, the flat antenna (20) is mounted in the casing (10) and connected electronically to a digital television (not shown) through an external coaxial cable (30). The external coaxial cable (30) has a core conductor (31) and a braided layer (not shown). The flat antenna (20) has a feed point (21) and a ground point (22). The flat antenna (20) can be any shape, for example, rectangular, circular, straight, etc.

The coaxial cable connector (11) is mounted through the casing (10), protrudes inside and outside the casing (10) and has an inner conductor (111) and multiple outer conductors (112). At least one outer conductor (112) is connected between the ground point (22) of the flat antenna (20) and the braided layer of the external coaxial cable (30).

Figure 4:
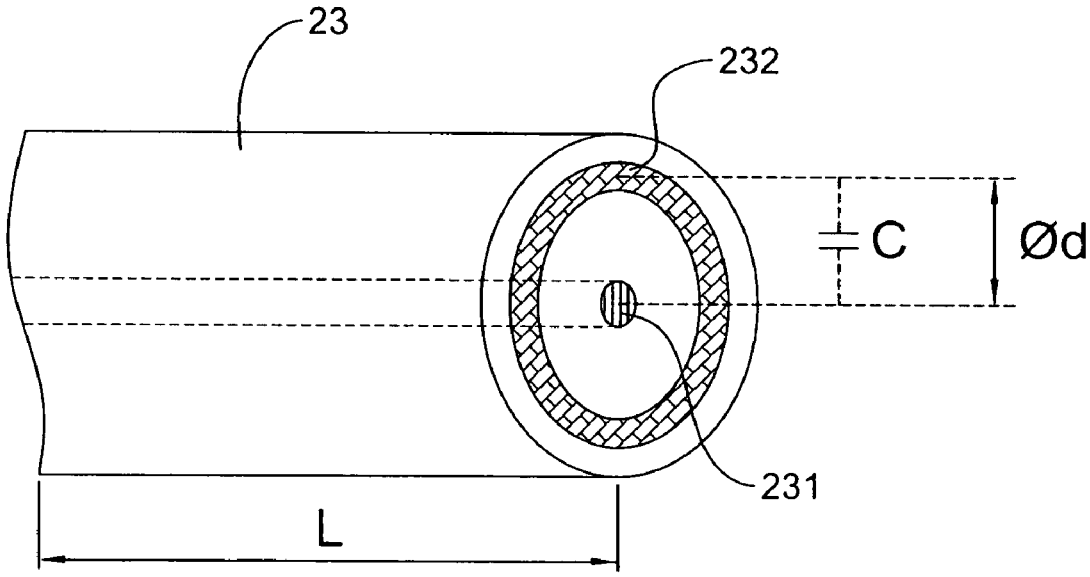
FIG.4 (PRIOR ART)
FIG. 4 is a cross sectional view of a conventional coaxial cable.
Figure 5:
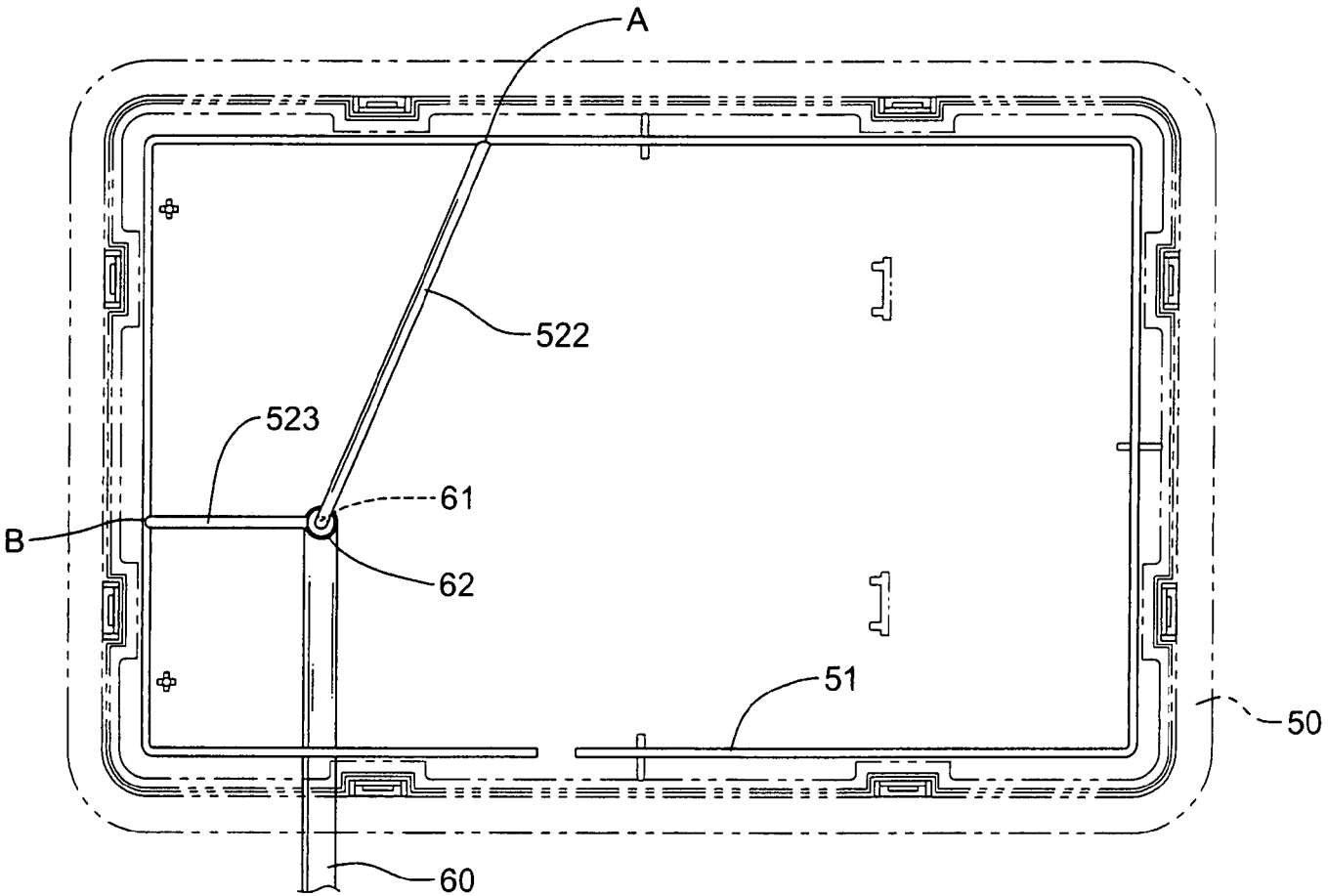
FIG.5 (PRIOR ART)
FIG. 5 is a top view of a conventional small digital receiving antenna device in accordance with the prior art.
Figure 6:
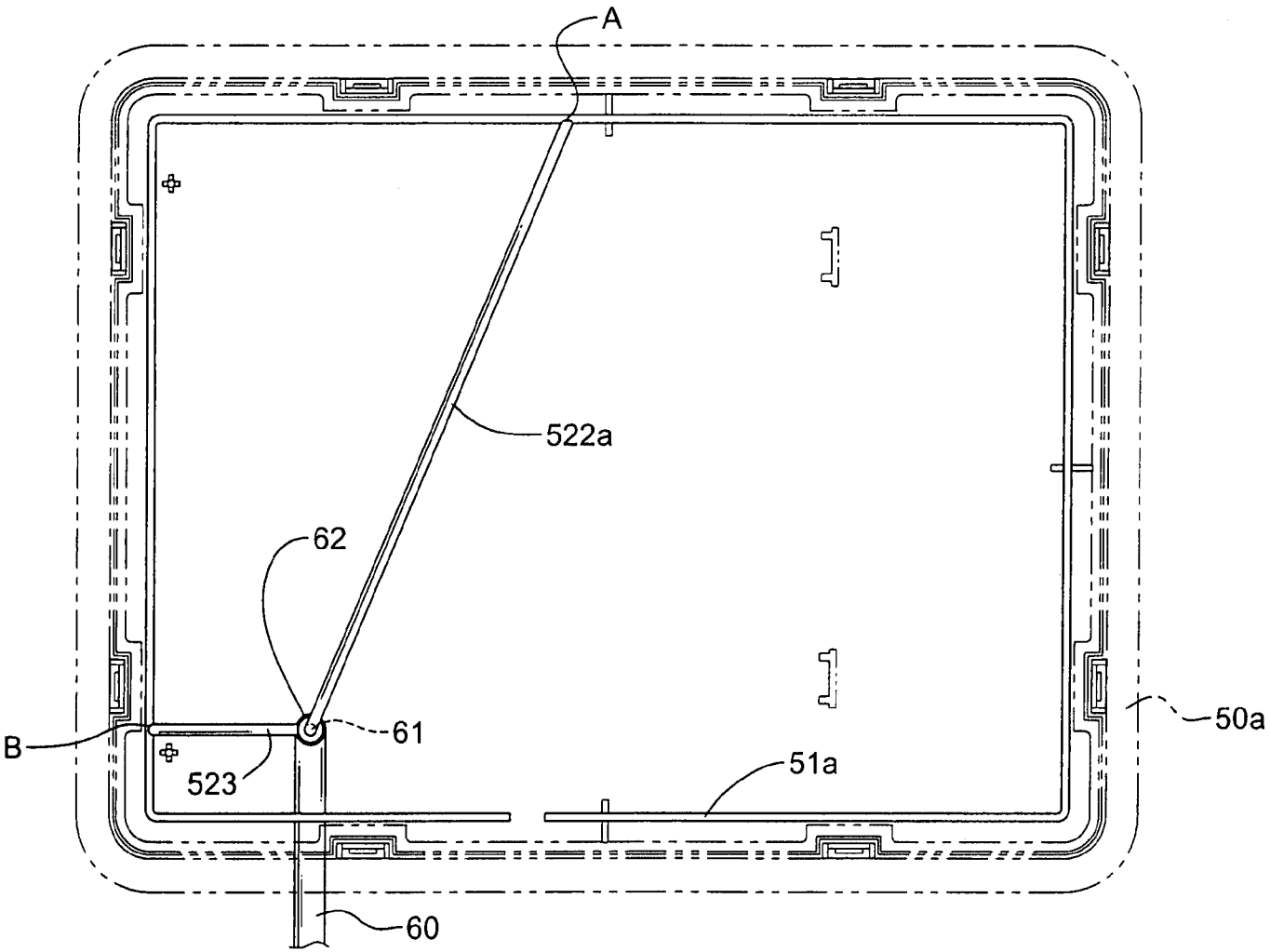
FIG.6 (PRIOR ART)
FIG. 6 is a top view of a conventional large digital receiving antenna device in accordance with the prior art.

With further reference to FIG. 4, the coaxial transmission line (23) inside the casing (10) has a core conductor (231), a braided layer (232), insulating material and a fixed capacitance (C). The insulating material separates the braided layer (232) from the core conductor (231) by a fixed distance, which results in the fixed capacitance (C) between core conductor (231) and the braided layer (232). The core conductors (231, 31) of the coaxial transmission line (23) and the external coaxial cable (30) are electronically connected together through the inner conductor (111) of the coaxial cable connector (11). The braided layer (232) of the coaxial transmission line (23) is connected to the feed point (21) of the flat antenna (20). The braided layer of the external coaxial cable (30) is connected electronically to the ground point (22) through one of the outer conductors (112) of the coaxial cable connector (11).

Since the coaxial transmission line (23) mounted inside has a fixed capacitance, the capacitance is the same without regard to the distance between the feed point (21) and the coaxial cable connector (11). When the feed point (21) of the flat antenna (20) is connected electronically to the external coaxial cable (30) through the coaxial transmission line (23) mounted inside the casing (10), a fixed capacitance (C) is connected between the feed point (21) and the external coaxial cable (30). Therefore, a large digital receiving antenna using a coaxial transmission line to connect between the large flat antenna device and the external coaxial cable (30) has the same impedance as different size digital receiving antenna device using a coaxial transmission line (23), because the coaxial transmission lines (23) have the same capacitance. Therefore, different size digital receiving antenna devices can use the same antenna signal processing circuit because the impedance of the flat antenna (20) matches the antenna signal processing circuit.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A digital receiving antenna device, comprising:

a casing;

a flat antenna mounted in the casing and connecting electronically to an external coaxial cable, that is adapted to be connected to a digital television and has a core conductor and a braided layer, and the flat antenna having a feed point; and a ground point;

a coaxial cable connector mounted through casing, protruding inside and outside the casing, connecting to the external coaxial cable and having an inner conductor; and at least one outer conductor; and a coaxial transmission line mounted inside the casing, connected between the feed point of the flat antenna and the external coaxial cable and having a core conductor connected to the external coaxial cable; and a braided layer connected to the feed point and covering the core conductor.

2. The antenna device as claimed in claim 1, wherein the core conductor of the coaxial transmission line is connected to the inner conductor.

3. The antenna device as claimed in claim 1, wherein the at least one outer conductor is connected to the ground point of the flat antenna.

4. The antenna device as claimed in claim 2, wherein the at least one outer conductor is connected to the ground point of the flat antenna.

5. The antenna device as claimed in claim 1, wherein the flat antenna is rectangular.

* * * * *